US011661321B2

(12) United States Patent
Su et al.

(10) Patent No.: US 11,661,321 B2
(45) Date of Patent: May 30, 2023

(54) LIFTING DEVICE

(71) Applicant: Quzhou T-Nine Tools Co., Ltd., Zhejiang (CN)

(72) Inventors: John Su, Zhejiang (CN); Shuttle Wang, Zhejiang (CN)

(73) Assignee: Quzhou T-Nine Tools Co., Ltd., Quzhou (CN)

( * ) Notice: Subject to any disclaimer, the term of this patent is extended or adjusted under 35 U.S.C. 154(b) by 297 days.

(21) Appl. No.: 17/111,804

(22) Filed: Dec. 4, 2020

(65) Prior Publication Data

US 2021/0362989 A1 Nov. 25, 2021

(30) Foreign Application Priority Data

May 20, 2020 (CN) ..... 202010431142.9

(51) Int. Cl.

| | |
|---|---|
| ***B66C 23/62*** | (2006.01) |
| ***B66C 9/14*** | (2006.01) |
| ***B66C 23/64*** | (2006.01) |
| ***B66F 3/20*** | (2006.01) |
| ***B66F 3/14*** | (2006.01) |
| ***B66F 17/00*** | (2006.01) |
| *B66D 1/54* | (2006.01) |
| *B66C 19/00* | (2006.01) |

(52) U.S. Cl.

CPC ..... *B66F 3/20* (2013.01); *B66C 9/14* (2013.01); *B66C 23/62* (2013.01); *B66C 23/64* (2013.01); *B66F 3/14* (2013.01); *B66F 17/00* (2013.01); *B66C 19/00* (2013.01); *B66D 1/54* (2013.01)

(58) Field of Classification Search

CPC ... B66F 3/20; B66F 3/14; B66F 17/00; B66D 1/54; B66D 1/36; B66D 1/14; B66D 1/20; B66D 1/26; B66D 1/24; B66D 5/32; B66C 23/44; B66C 23/62; B66C 23/202; B66C 9/14; B66C 23/64; H02G 1/08; H02G 1/085; F16M 13/022

USPC ..... 212/174, 233, 311

See application file for complete search history.

(56) References Cited

U.S. PATENT DOCUMENTS

2011/0156430 A1* 6/2011 Gardner ..... B60P 3/34 254/311

2018/0128540 A1* 5/2018 Yasaka ..... B66F 7/02

FOREIGN PATENT DOCUMENTS

CN 202903469 U 4/2013

* cited by examiner

*Primary Examiner* — Mahdi H Nejad

(57) ABSTRACT

A lifting device includes a drive, a speed change gear device arranged above the drive and configured to be rotatable by means of the drive, a transmission device connected to the speed change gear device and a lifting mechanism fixed in the transmission device, and the speed change gear device is fixed to a side wall of the transmission device. Under an action of the drive and a speed change of speed change gear device, a gravity of a weight suspended on the lifting device is converted, so that the weight is lifted under a small force. The lifting device can also be driven via an electric hand tool. In addition, a first transmission device and a second transmission device are provided with a safety device to lock the lifting device when reaching a top, so as to prevent the lifting device from slipping to cause injuries.

8 Claims, 7 Drawing Sheets

LIFTING DEVICE

CROSS-REFERENCE TO RELATED APPLICATIONS

This application claims the benefit of priority from Chinese Patent Application No. 202010431142.9, filed on May 20, 2020. The content of the aforementioned applications, including any intervening amendments thereto, is incorporated herein by reference in its entirety.

TECHNICAL FIELD

The present disclosure relates to lifting equipment, and more particularly to a lifting device.

BACKGROUND

Chinese utility model No. CN201220598987.8 provides a platform for detecting a safety lock of a hanging basket, which includes a bracket, a lifting device, a transmission device, a motor and a weight. The lifting device is connected to the bracket via a guide groove. The transmission device is connected to the lifting device via a steel wire. An output end of the motor is fixedly connected to the transmission device. The weight is placed in the lifting device, and a mounting frame for the safety lock to be tested is provided on the lifting device. This utility model can detect the basic performance of the safety lock quickly and effectively, so as to evaluate the carrying capacity, sensitivity and safety performance of the safety lock in a short time. However, the lifting mechanisms used in some maintenance equipment or handling and unloading sites still require motors to provide power, so such lifting mechanisms cannot work without power equipment, which in turn limits their use environments and brings a lot of inconvenience.

SUMMARY

1. Technical Problems to be Solved

Aiming at the problems in the prior art, the present disclosure provides a lifting device. The lifting device includes a drive, a speed change gear device arranged above the drive and configured to be rotatable by means of the drive, a first transmission device fixed to an outer wall of the speed change gear device, a second transmission device connected to the first transmission device via a connecting shaft, a safety device fixed in the first transmission device and the second transmission device respectively and a lifting mechanism. By manually driving the transmission device, a force is converted under a speed change of a gear set, and a weight is lifted under the drive of the first transmission device, the second transmission device and the lifting mechanism. When a maximum height is reached, the lifting mechanism is locked via the safety device. The lifting mechanism is provided with a chain-hoist brake device, which can stop the lifting process at any time. The chain-hoist brake device is bidirectionally movable, and is safe and convenient in use.

2. Technical Solutions

The technical solutions to solve the above-mentioned problems are shown as follows.

A lifting device, comprising:

a drive;

a speed change gear device arranged above the drive and configured to be rotatable by means of the drive;

a transmission device connected to the speed change gear device, wherein the speed change gear device is fixed to a side wall of the transmission device; and a lifting mechanism that is fixed in the transmission device.

In some embodiments, the transmission device comprises:

a first transmission device fixed to the speed change gear device;

a second transmission device connected to the first transmission device via a connecting shaft; and a safety device fixed in the first transmission device and the second transmission device, respectively.

In some embodiments, the first transmission device comprises:

a first rotating wheel arranged in a base of the first transmission device;

a first bearing seat for fixing a bearing arranged outside a side wall of the base of the first transmission device; and a fixed pulley arranged at an upper end of the base of the first transmission device away from the first rotating wheel of the first transmission device;

wherein the first rotating wheel is connected to a second drive shaft and rotates with the second drive shaft.

In some embodiments, second transmission device comprises:

a driven shaft arranged in a base of the second transmission device with an end connected to the connecting shaft;

a second rotating wheel arranged in the base of the second transmission device and connected to the driven shaft;

a second bearing seat fixed to two outer walls of the base of the second transmission device respectively and connected to the driven shaft via bearings;

a gear washer fixed to an end surface of the driven shaft via screws; and a fixed pulley fixed to an upper end of the base of the second transmission device away from the second rotating wheel of the second transmission device;

wherein the second transmission device is connected to the connecting shaft via the driven shaft, so that the first transmission device and the second transmission device are rotatable synchronously.

In some embodiments, the safety device is fixed to an end away from the connecting shaft in the first transmission device and the second transmission device, respectively;

wherein the safety device comprises:

a lock bracket fixed in a base of the first transmission device and the second transmission device, respectively;

a bolt that is arranged in the lock bracket, wherein the bolt penetrates both ends of the lock bracket and is movable along a length of the bolt;

a locking plat arranged on an upper part of the lock bracket and configured to be overturnable via fixed points on both sides of the lock bracket;

a return spring located on an outer peripheral surface of the bolt; and a reset plate arranged at a left side of the lock bracket;

wherein a limit pin is arranged at a middle of the bolt; a U-shaped guide groove is arranged on the lock bracket matching the limit pin; the limit pin is arranged in the U-shaped guide groove and is slidable along a length of the U-shaped guide groove; and the return spring is arranged between the limit pin and the reset plate.

In some embodiments, bottoms of the bases of the first transmission device and the second transmission device are respectively provided with an opening matching the lifting mechanism, and the opening is arranged at a part of the locking plate protruding from the lock bracket.

In some embodiments, the speed change gear device comprises:

a housing; and a gear set fixed in the housing;

wherein the gear set comprises:

a rotating gear;

a first transmission gear engaged with the rotating gear;

a second transmission gear fixed to a side of the first transmission gear via a rotating shaft and configured to be rotatable with the first transmission gear; and a driven gear engaged with the second transmission gear;

wherein the driven gear is fixed via the second drive shaft; the second drive shaft is connected to the first transmission device to provide power to the first transmission device and the second transmission device; and one end of the second drive shaft is connected to the driven gear, and the other end of the second drive shaft penetrates a side wall of the first transmission device and is connected to the connecting shaft.

In some embodiments, the drive comprises:

a housing of the drive;

a first drive shaft arranged on both sides of the housing of the drive;

a drive wheel;

a chain-hoist brake device fixed to an outer side the speed change gear device;

a sprocket attached to an end surface of the chain-hoist brake device; and a chain with one end connected to the drive wheel and the other end connected to the sprocket;

wherein one end of the first drive shaft is connected to the drive wheel, and the other end of the first drive shaft penetrates the housing of the drive from one end to the other end of the housing of the drive; part of the first drive shaft inside the housing of the drive is cooperated with the gear set in the drive; a free end surface of the first drive shaft is provided with a hexagonal connecting hole that is able to connect to a handle or an electric hand tool; and the drive is a hand chain type, hand crank type or motor-driven type.

In some embodiments, the chain-hoist brake device comprises:

a long shaft fixed in a housing of the speed change gear device with one end connected to the rotating gear;

a friction plate base;

a friction plate;

a ratchet wheel; and a pawl with one end fixed outside of the housing of the speed change gear device and the other end in contact with the ratchet wheel;

wherein the friction plate base, the friction plate, the ratchet wheel and the friction plate are fixed to an outer side of the speed change gear device in sequence via connecting to the long shaft.

In some embodiments, the lifting mechanism comprises:

a connecting belt;

wherein one end of the connecting belt is connected to the first rotating wheel and the second rotating wheel, so as to rotate with the first transmission device and the second transmission device to be wound and released;

a connecting rod connected to the other end of the connecting belt;

two hanging clips in right-left connection through the connecting rod; and a webbing clip to connect and fix the connecting rod to the connecting belt.

3. Beneficial Effects

1) A lifting device includes a drive, a speed change gear device arranged above the drive and configured to be rotatable by means of the drive, a first transmission device fixed to an outer wall of the speed change gear device, a second transmission device connected to the first transmission device via a connecting shaft, a safety device fixed in the first transmission device and the second transmission device respectively and a lifting mechanism. By manually driving the transmission device, a gravity of a weight suspended on the lifting device is converted via the speed change gear device, so that the weight is lifted under a small force. An end of a first drive shaft is provided with a hexagonal connecting hole, so that an electric hand tool is able to drive the lifting device to work, so as to lift the weight with a small force compared to the prior art.

2) In the lifting device, the safety device fixed in the first transmission device and the second transmission device respectively and a lifting mechanism. When the weight is lifted to a maximum height, the lifting mechanism is locked via touching the safety device to prevent the weight from falling under the gravity when an operator let it go to cause injuries. When lowering down the weight, the operator pulls a rope connected to an end of the limit pin to open the limit pin and unlock the safety device.

3) In the lifting device, a chain-hoist brake device is provided in a driven device. When lifting a weight, an operator stands on a side of the sprocket and pulls the chain downward to drive a sprocket to rotate in a clockwise direction. Under a transmission of transmission gears, the sprocket drives a lifting mechanism to rotate and the lifting mechanism drives a weight to rise. The weight can stay at any position in the air without falling by itself under the action of the chain-hoist brake device. When lowering the weight, the operator pulls down another chain to drive the sprocket to rotate counterclockwise. At the same time, a pawl releases a ratchet wheel, and the weight can be lowered smoothly under its own weight. When the operator stops pulling the chain, the chain-hoist brake device immediately resumes its braking function, so that the weight can be stopped at any position. In this way, the hazards caused by the sharp falling-off of weights are effectively prevented when the weights are lifted and lowered.

Figure 1:
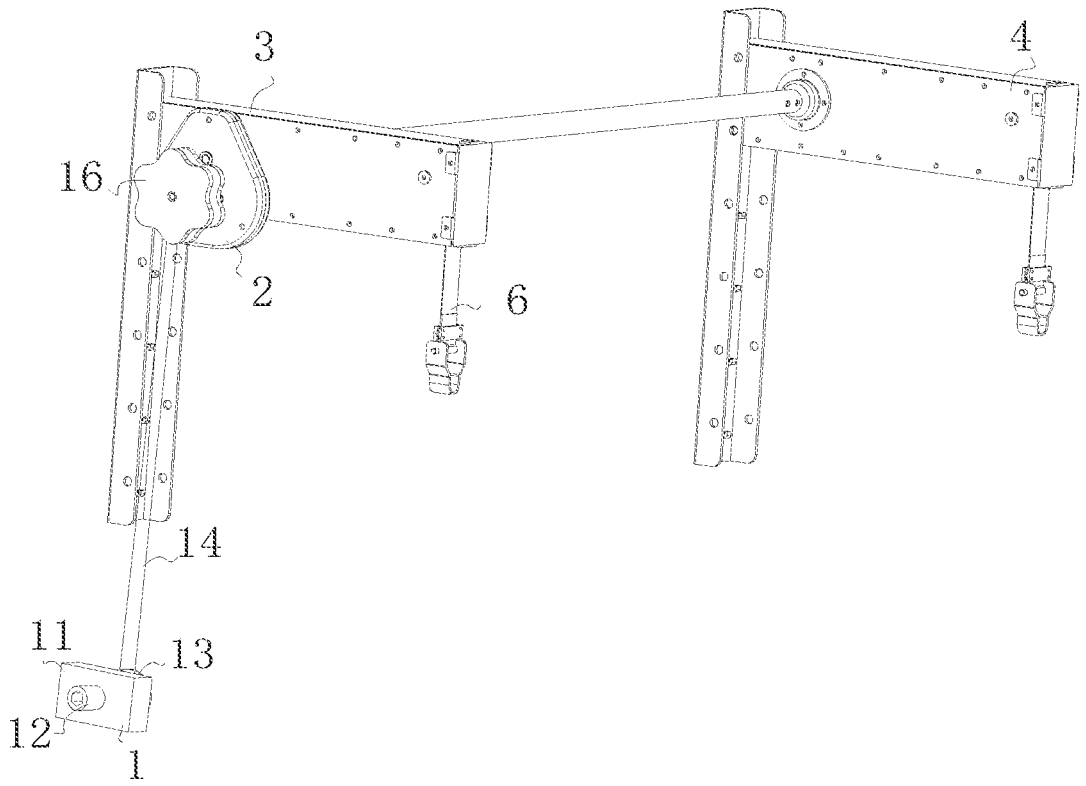
FIG. 1 depicts a perspective view of a lifting device in accordance with the present disclosure.
Figure 2:
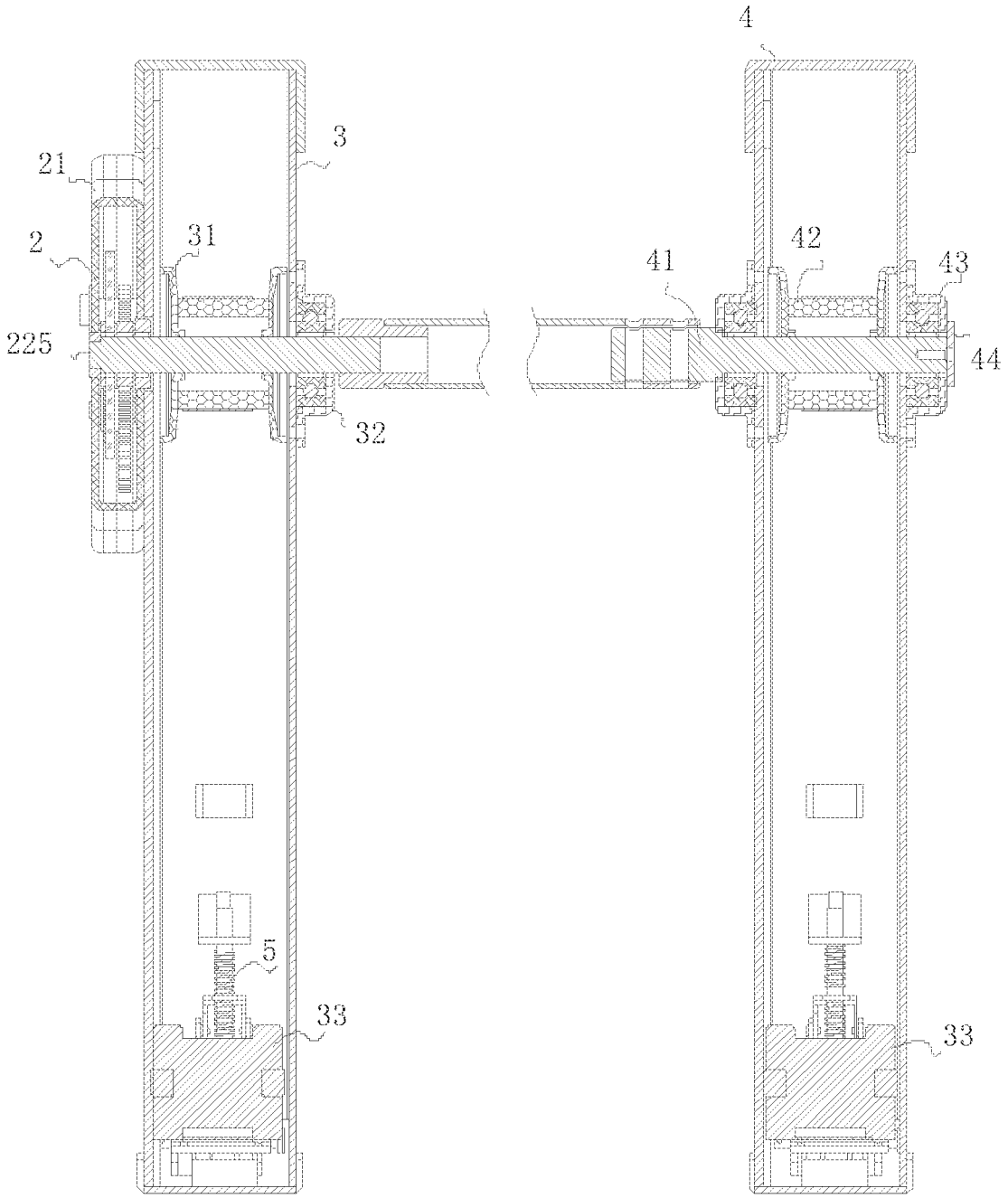
FIG. 2 is a sectional view of a first transmission device and a second transmission device of the lifting device in accordance with the present disclosure.
Figure 3:
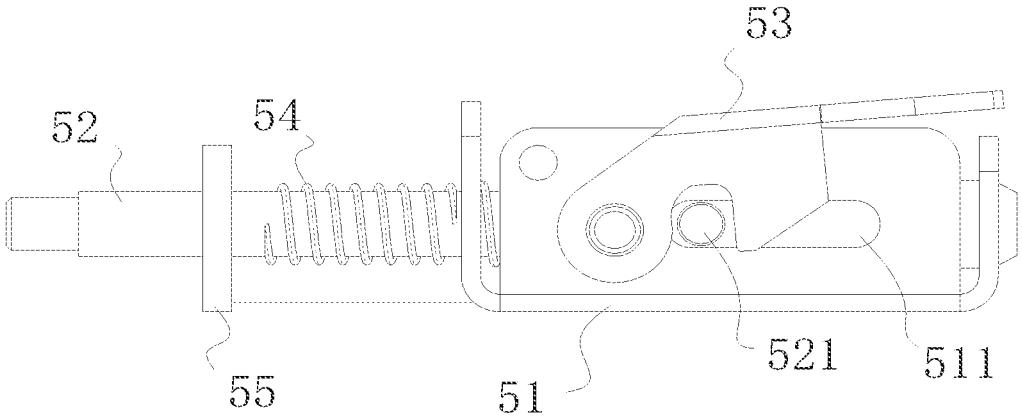
FIG. 3 depicts a safety device of the lifting device in accordance with the present disclosure.
Figure 4:
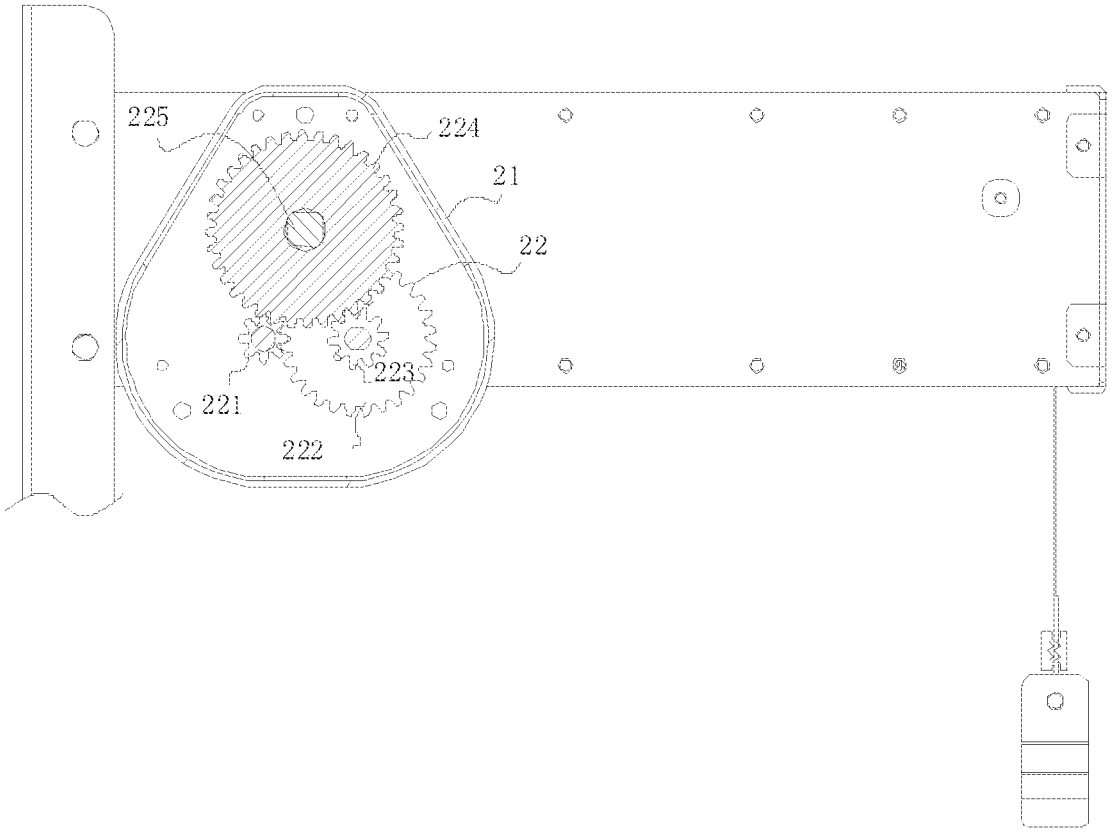
FIG. 4 is a sectional view of a speed change gear device of the lifting device in accordance with the present disclosure.
Figure 5:
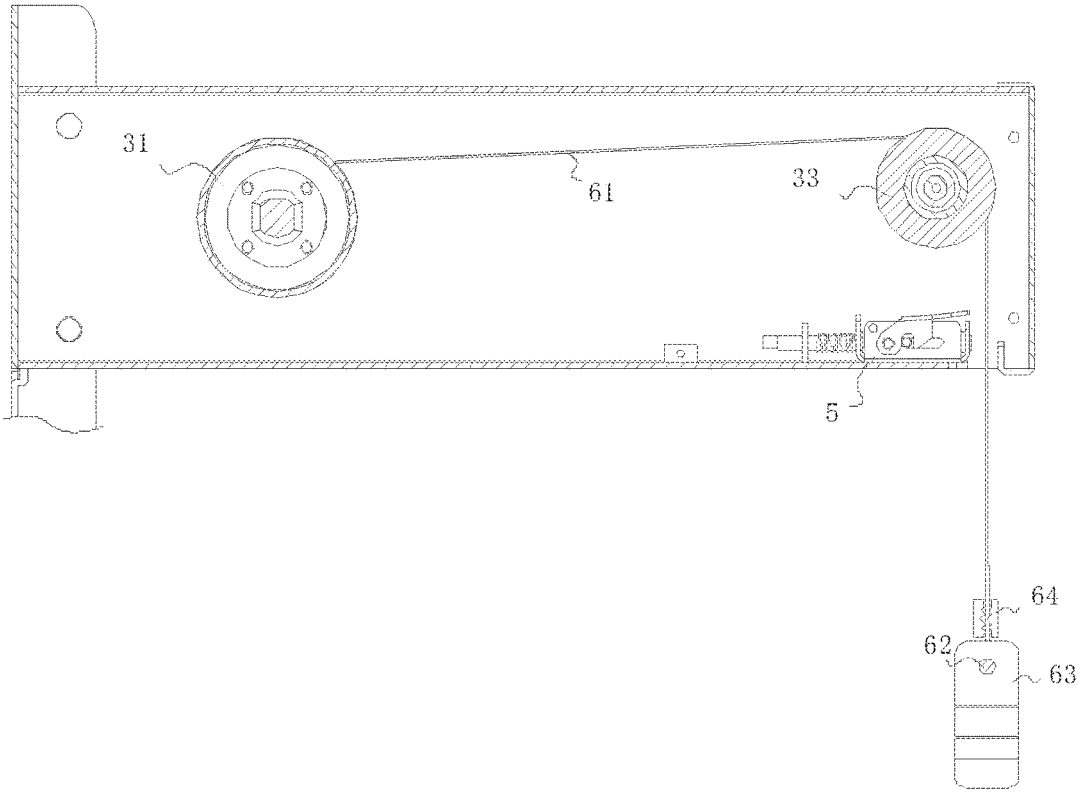
FIG. 5 is a cross-sectional view of the first transmission device of the lifting device in accordance with the present disclosure.
Figure 6:
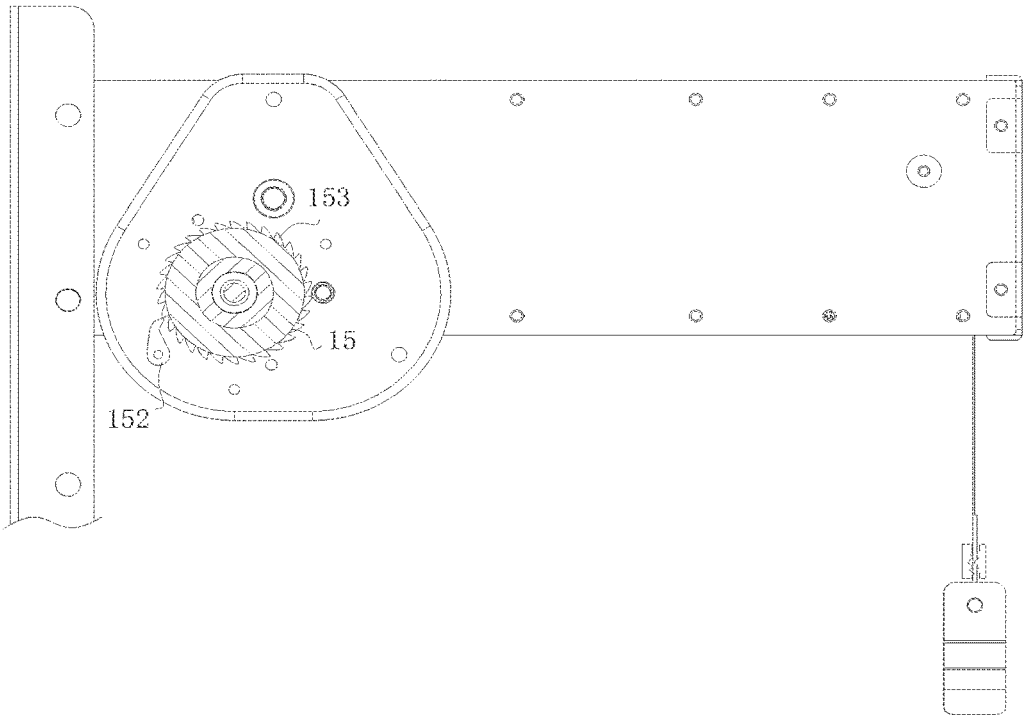
FIG. 6 is a cross-sectional view of a chain-hoist brake device of the lifting device in accordance with the present disclosure.
Figure 7:
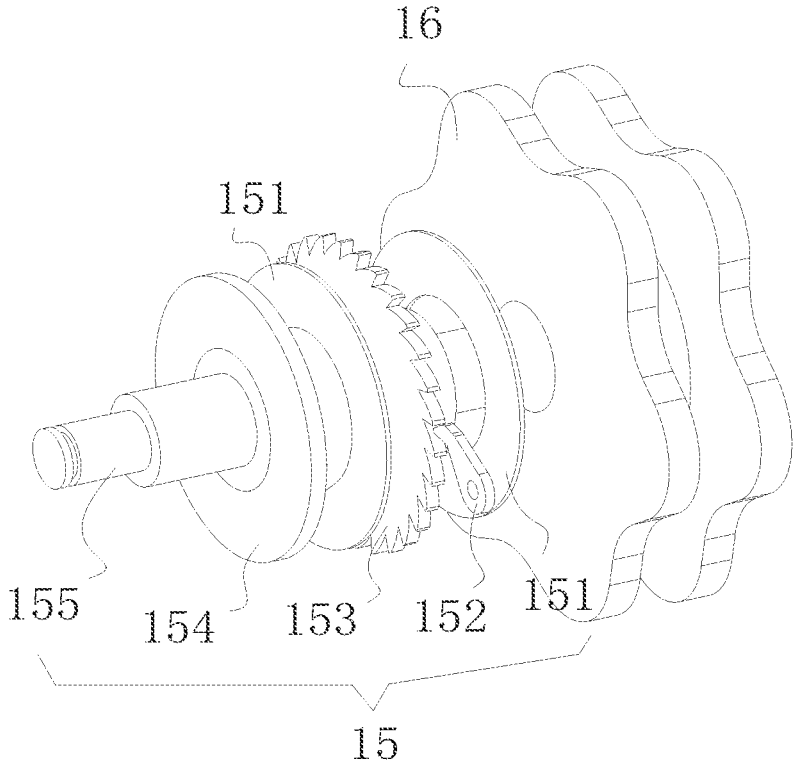
FIG. 7 depicts a perspective view of the chain-hoist brake device of the lifting device in accordance with the present disclosure.

in the drawings: 1, drive; 11, housing of drive; 12, first drive shaft; 13, drive wheel; 14, chain; 15, chain-hoist brake device; 151, friction plate; 152, pawl; 153, ratchet wheel; 154, friction plate base; 155, long shaft; 16, sprocket;

2, transmission device; 21, housing of transmission device; 22, gear set; 221, rotating gear; 222, first transmission gear; 223, second transmission gear; 224, driven gear; 225, second drive shaft;

3, first transmission device; 31, first rotating wheel; 32, first bearing seat; 33, fixed pulley;

4, second transmission device; 41, driven shaft; 42, second rotating wheel; 43, second bearing seat; 44, gear washer;

5, safety device; 51, lock bracket; 511, U-shaped guide groove; 52, bolt; 521, limit pin; 53, locking plate; 54, return spring; 55, reset plate;

6, lifting mechanism; 61, connecting belt; 62, connecting rod; 63, hanging clip; and 64, webbing clip.

DETAILED DESCRIPTION OF EMBODIMENTS

The embodiments of the present disclosure will be described clearly and completely with reference to the accompanying drawings. The embodiments herein are only part of the embodiments of the present disclosure, and any other embodiments obtained by those skilled in the art without creative work should fall in the scope of the present disclosure.

As shown in FIGS. 1-9, a lifting device includes a drive 1, a speed change gear device 2 arranged above the drive 1 and configured to be rotatable by means of the drive 1, a transmission device connected to the speed change gear device 2 and a lifting mechanism 6 that is fixed in the transmission device, and the speed change gear device is fixed to a side wall of the transmission device. The transmission device is multi-point or single-point transmission. The transmission device herein includes a first transmission device 3 and a second transmission device 4 connected to the first transmission device 3 via a connecting shaft. In order to effectively prevent safety hazards, the first transmission device 3 and the second transmission device 4 are respectively provided with a safety device 5 therein.

The safety device 5 is fixed to an end away from the connecting shaft in the first transmission device 3 and the second transmission device 4, respectively. The safety device 5 includes a lock bracket 51 fixed in a base of the first transmission device 3 and the second transmission device 4 respectively, a bolt 52 that is arranged in the lock bracket 51, penetrates both ends of the lock bracket 51, and is movable along a length of the bolt 52, a locking plate 53 arranged on an upper part of the lock bracket 51 and configured to be overturnable via fixed points on both sides of the lock bracket 51, a return spring 54 located on an outer peripheral surface of the bolt 52 and a reset plate 55 arranged at a left side of the lock bracket 51. A limit pin 521 is arranged at a middle of the bolt 52. A U-shaped guide groove 511 is arranged on the lock bracket 51 matching the limit pin 521. The limit pin 521 is arranged in the U-shaped guide groove 511 and is slidable along a length of the U-shaped guide groove. The return spring 54 is arranged between the limit pin 521 and the reset plate 55. In the bases of the first transmission device 3 and the second transmission device 4, a concave support plate matching the bolt 52 is provided in front of a movement area of the bolt 52. A hole is formed at an end of the bolt 52 protruding from the reset plate 55 to tie a rope, and the rope passes through a hole at a bottom of the base. In order to prevent the rope from being worn out, a sliding wheel is arranged between the bolt 52 and the hole formed on the base, which prevents the rope from being worn off and saves effort.

The drive 1 is a hand chain type, a hand crank type or a motor-driven type. The drive 1 of the hand chain type includes a chain 14 for transmission and a transmission wheel fixed to an outer side of the speed change gear device 2. The transmission wheel is connected to the chain 14. The drive 1 of the hand crank type or the motor-driven type includes a housing 11, a first drive shaft 12 arranged on both sides of the housing 11, a drive wheel 13, a chain-hoist brake device 15 fixed to an outer side of the speed change gear device 2, a sprocket 16 that is attached to an end surface of the chain-hoist brake device 15 and a chain 14 with one end connected to the drive wheel 13 and the other end connected to the sprocket 16. One end of the first drive shaft 12 is connected to the drive wheel 13, and the other end of the first drive shaft 12 penetrates the housing 11 of the drive 1 from one end to the other end of the housing 11 of the drive 1. A part of the first drive shaft 12 inside the housing 11 of the drive 1 is cooperated with a gear set in the drive 1. A free end surface of the first drive shaft 12 is provided with a hexagonal connecting hole that can be connected to a handle and an electric hand tool, which are used to drive the lifting device The chain-hoist brake device 15 includes: a long shaft 155 fixed in a housing 21 of the speed change gear device 2 with one end connected to a rotating gear 221; a friction plate base 154, a friction plate 151, a ratchet wheel 153 and a friction plate 151 fixed to an outside of the speed change gear device in sequence through the long shaft 155; and a pawl 152 with one end fixed outside of the housing 21 of the speed change gear device 2 and the other end in contact with the ratchet wheel 153. The sprocket 16 is fixed to an end of the long shaft 155, and the sprocket 16 can drive the chain-hoist brake device 15 to rotate. When lifting a weight, an operator stands on a side of the sprocket 16 and pulls the chain 14 downward to drive the sprocket 16 to rotate in a clockwise direction. Under a transmission of the transmission gears, the sprocket 16 drives the lifting mechanism 6 to rotate and the lifting mechanism 6 drives a weight to rise. The weight can stay at any position in the air without falling by itself under the action of the chain-hoist brake device 15. When lowering the weight, the operator pulls down another chain 14 to drive the sprocket 16 to rotate counterclockwise. At the same time, the pawl 152 releases the ratchet wheel 153, and the weight can be lowered smoothly under its own weight. When the operator stops pulling the chain 14, the chain-hoist brake device 15 immediately resumes its braking function, so that the weight can be stopped at any position.

The speed change gear device 2 includes the housing 21 of the speed change gear device and a gear set 22 fixed in the housing 21 of the speed change gear device 21. The gear set 22 includes the rotating gear 221, a first transmission gear 222 engaged with the rotating gear 221, a second transmission gear 223 that is fixed to a side of the first transmission gear 222 via a rotating shaft and is rotatable with the first transmission gear 222 and a driven gear 224 engaged with the second transmission gear 223. The driven gear 224 is fixed via a second drive shaft 225. The second drive shaft 225 is connected to the first transmission device 3 to provide power to the first transmission device 3 and the second transmission device 4. One end of the second drive shaft 225 is connected to the driven gear 224 and the other end of the second drive shaft 225 penetrates a side wall of the first transmission device 3 and is connected to the connecting shaft. The engagements between the gears and adjustments of the number of gear teeth achieve an effect of saving effort. A pulling force of the chain 14 in the drive 1 is converted by the speed change gear device 2 and then is transferred to the first transmission device 3 and the second transmission device 4 to drive the first transmission device 3 and the second transmission device 4 to work.

The first transmission device 3 includes a first rotating wheel 31 arranged in the base of the first transmission device 3, a first bearing seat 32 arranged outside a side wall of the base of the first transmission device 3 for fixing a bearing and a fixed pulley 33 of the first transmission device 3 arranged at an upper end of the base of the first transmission device 3 away from the first rotating wheel 31. The second transmission device 4 includes a driven shaft 41 arranged in the base of the second transmission device 4 with an end connected to the connecting shaft, a second rotating wheel 42 arranged in the base of the second transmission device 4 and connected to the driven shaft 41, a second bearing seat 43 respectively fixed outside two side walls of the base of the second transmission device 4 and connected to the driven shaft 41 via bearings, a gear washer 44 fixed to an end surface of the driven shaft 41 via screws and a fixed pulley 33 of the second transmission device 4 fixed to an upper end of the base of the second transmission device 4 away from the second rotating wheel 42. The lifting mechanism 6 is fixed in the first transmission device 3 and the second transmission device 4, respectively. The lifting mechanism 6 includes a connecting belt 61, and one end of the connecting belt 61 is connected to the first rotating wheel 31. The connecting belt 61 winds and releases with the rotating of the first transmission device 3 and the second transmission device, and a direction of the connecting belt 61 is changeable via the fixed pulley 33 of the first transmission device 3 or the fixed pulley 33 of the second transmission device 4. The lifting mechanism further includes a connecting rod 62 connected to the other end of the connecting belt 61, two hanging clips 63 in a left-right connection through the connecting rod 6 and a webbing clip 64 to connect and fix the connecting rod 62 to the connecting belt 61.

The chain-hoist brake device 15 and the lifting mechanism 6 provided herein it can lift a weight weighing less than 500 kg.

When the lifting device operates, the drive 1 provides an external force and is connected to the sprocket 16 via the chain 14 to drive the speed change gear device 2 to rotate. The second drive shaft 225 in the speed change gear device 2 is connected to the first rotating wheel 31. With the rotation of the second drive shaft 225, a changed force of the transmission device 2 is transmitted to the first transmission device 3, and the force is transmitted to the second transmission device 4 via a chain link between the connecting shaft and the driven shaft 41, so that the first transmission device 3 and the second transmission device 4 rotate synchronously, and drive the connecting belt 61 to wind to drive the lifting mechanism 6 to work. The lifting mechanism 6 lift a weight clamped by the hanging clips. When the hanging clips 63 rise to a highest position, the hanging clips 63 touch the locking plate 53 of the safety device 5 and flip upwards. Under an elastic force of the return spring 54, the limit pin 521 is pushed to slide from the innermost end to the outermost end of the U-shaped guide groove 511. The bolt 52 is driven to slide out from an end surface of the lock bracket 51 and fix the connecting belt 61 on a concave support bracket to stop the lifting device. When lowering the weight, a rope connected to an end of the bolt 52 is pulled, such that the limit pin 521 pushes the locking plate 53 to flip upward and the limit pin 521 engages with the locking plate 53 in snap fit to open the safety device 5 and lower the weight.

Figure 8:
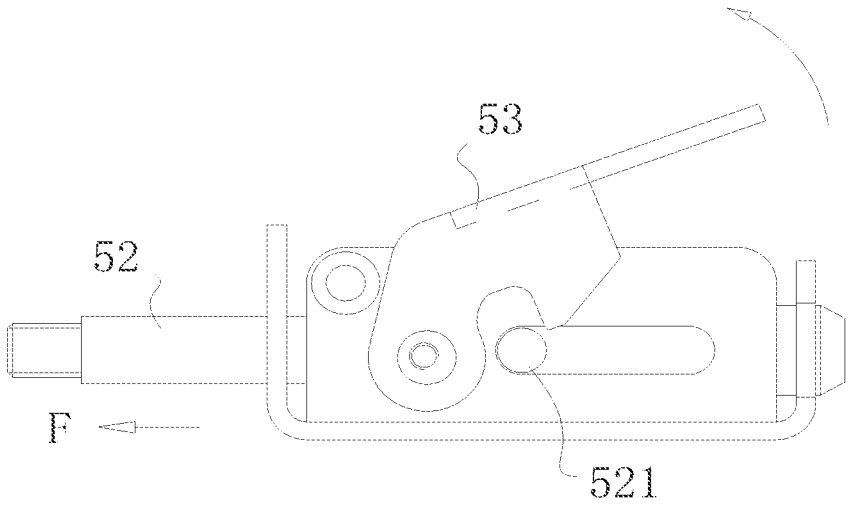
FIG. 8 depicts the safety device in an unlocked state of the lifting device in accordance with the present disclosure.
Figure 9:
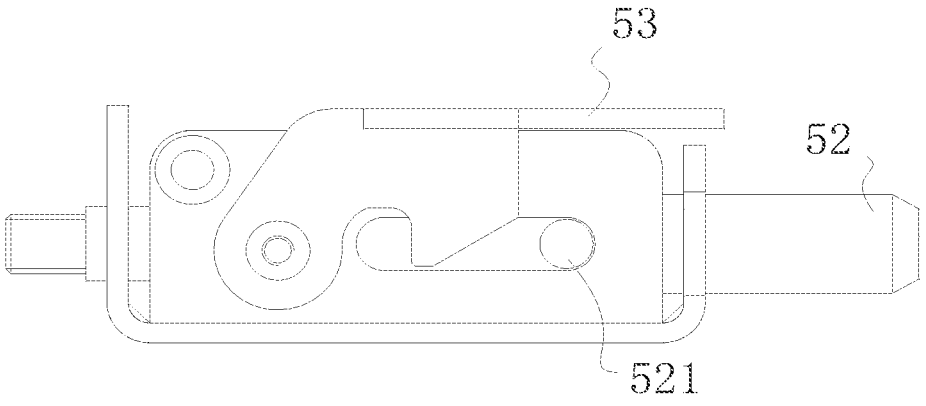
FIG. 9 depicts the safety device in a locked state of the lifting device in accordance with the present disclosure.

FIGS. 8-9 depict the safety device 5 in an unlocked and a locked state, respectively. As shown in FIG. 8, when an external force is applied to a left end of the bolt 52, the limit pin 521 is driven to move to the left and push the locking plate 53 to flip up, so that the limit pin 521 finally snaps into a groove of the locking plate 53 to unlock the safety device 5. Referring to FIG. 9, when the safety device 5 is in the locked state, the bolt 52 protrudes to the right and abuts against the connecting belt 61, so as to further fix the connecting belt 61.

The above-mentioned embodiments are some preferred embodiments, and not intended to limit the scope of the present invention. For those skilled in the art, any replacements and modifications within a spirit of the present invention should fall in the scope of the present invention.

What is claimed is:

1. A lifting device, comprising:

a drive;

a speed change gear device arranged above the drive and configured to be rotatable by means of the drive;

a transmission device connected to the speed change gear device, wherein the speed change gear device is fixed to a side wall of the transmission device; and a lifting mechanism fixed in the transmission device, the lifting mechanism comprising;

a first transmission device fixed to the speed change gear device;

a second transmission device connected to the first transmission device via a connecting shaft; and a safety device fixed in the first transmission device and the second transmission device, respectively;

wherein the first transmission device comprises:

a first rotating wheel arranged in a base of the first transmission device;

a first bearing seat for fixing a bearing arranged outside a sidewall of the base of the first transmission device; and a fixed pulley arranged at an upper end of the base of the first transmission device away from the first rotating wheel of the first transmission device;

wherein the first rotating wheel is connected to a second drive shaft and rotates with the second drive shaft.

2. The lifting device of claim 1, the second transmission device comprises:

a driven shaft arranged in a base of the second transmission device with an end connected to the connecting shaft;

a second rotating wheel arranged in the base of the second transmission device and connected to the driven shaft;

a second bearing seat fixed to two outer side walls of the base of the second transmission device respectively and connected to the driven shaft via bearings;

a gear washer fixed to an end surface of the driven shaft via screws; and a fixed pulley fixed to an upper end of the base of the second transmission device away from the second rotating wheel of the second transmission device;

wherein the second transmission device is connected to the connecting shaft via the driven shaft, so that the first transmission device and the second transmission device are rotatable synchronously.

3. The lifting device of claim 2, wherein the lifting mechanism comprises:

a connecting belt;

wherein one end of the connecting belt is connected to the first rotating wheel and the second rotating wheel, so as to rotate with the first transmission device and the second transmission device to be wound and released;

a connecting rod connected to the other end of the connecting belt;

two hanging clips in right-left connection through the connecting rod; and a webbing clip to connect and fix the connecting rod to the connecting belt.

4. The lifting device of claim 1, wherein the speed change gear device comprises:

a housing; and a gear set fixed in the housing;

wherein the gear set comprises:

a rotating gear;

a first transmission gear engaged with the rotating gear;

a second transmission gear fixed to a side of the first transmission gear via a rotating shaft and configured to be rotatable with the first transmission gear; and a driven gear engaged with the second transmission gear;

wherein the driven gear is fixed via the second drive shaft; the second drive shaft is connected to the first transmission device to provide power to the first transmission device and the second transmission device; and one end of the second drive shaft is connected to the driven gear, and the other end of the second drive shaft penetrates a side wall of the first transmission device and is connected to the connecting shaft.

5. A lifting device, comprising:

a drive;

a speed change gear device arranged above the drive and configured to be rotatable by means of the drive;

a transmission device connected to the speed change gear device, wherein the speed change gear device is fixed to a side wall of the transmission device; and a lifting mechanism fixed in the transmission device;

wherein the transmission device comprises:

a first transmission device fixed to the speed change gear device;

a second transmission device connected to the first transmission device via a connecting shaft; and a safety device fixed in the first transmission device and the second transmission device, respectively;

wherein the safety device is fixed to an end away from the connecting shaft in the first transmission device and the second transmission device, respectively;

wherein the safety device comprises:

a lock bracket fixed in a base of the first transmission device and a base of the second transmission device, respectively;

a bolt arranged in the lock bracket, wherein the bolt penetrates both ends of the lock bracket and is movable along a length of the bolt;

a locking plate arranged on an upper part of the lock bracket and configured to be overturnable via fixed points on both sides of the lock bracket;

a return spring located on an outer peripheral surface of the bolt; and a reset plate arranged at a left side of the lock bracket;

wherein a limit pin is arranged at a middle of the bolt; a U-shaped guide groove is arranged on the lock bracket matching the limit pin; the limit pin is arranged in the U-shaped guide groove and is slidable along a length of the U-shaped guide groove; and the return spring is arranged between the limit pin and the reset plate.

6. The lifting device of claim 5, wherein bottoms of the bases of the first transmission device and the second transmission device are respectively provided with an opening matching the lifting mechanism; and the opening is arranged at a part of the locking plate protruding from the lock bracket.

7. A lifting device, comprising:

a drive;

a speed change gear device arranged above the drive and configured to be rotatable by means of the drive;

a transmission device connected to the speed change gear device, wherein the speed change gear device is fixed to a side wall of the transmission device; and a lifting mechanism fixed in the transmission device;

wherein the drive comprises:

a housing;

a first drive shaft arranged on both sides of the housing of the drive;

a drive wheel;

a chain-hoist brake device fixed to an outer side the speed change gear device;

a sprocket attached to an end surface of the chain-hoist brake device; and a chain with one end connected to the drive wheel and the other end connected to the sprocket;

wherein one end of the first drive shaft is connected to the drive wheel, and the other end of the first drive shaft penetrates the housing of the drive from one end to the other end of the housing of the drive; part of the first drive shaft inside the housing of the drive is cooperated with a gear set in the drive; a free end surface of the first drive shaft is provided with a hexagonal connecting hole that is able to connect to a handle or an electric hand tool; and the drive is a hand chain type, hand crank type or motor-driven type.

8. The lifting device of claim 7, wherein the chain-hoist brake device comprises:

a long shaft fixed in a housing of the speed change gear device with one end connected to a rotating gear;

a friction plate base, a friction plate, a ratchet wheel and the friction plate fixed to an outer side of the speed change gear device in sequence through the long shaft; and a pawl with one end fixed outside of the housing of the speed change gear device and the other end in contact with the ratchet wheel.

* * * * *